United States Patent [19]

Kirk

[11] Patent Number: 4,679,324

[45] Date of Patent: Jul. 14, 1987

[54] SAFETY RAZOR BLADES

[75] Inventor: Bryan R. Kirk, Basingstoke, England

[73] Assignee: The Gillette Company, Boston, Mass.

[21] Appl. No.: 795,969

[22] Filed: Nov. 7, 1985

[30] Foreign Application Priority Data

Nov. 15, 1984 [GB] United Kingdom ..... 8428921

[51] Int. Cl.[4] ..... B26B 21/54; B26B 21/06

[52] U.S. Cl. ..... 30/346.58; 30/50; 30/77

[58] Field of Search ..... 30/50, 55, 77, 83, 346.58, 30/346.59

[56] References Cited

U.S. PATENT DOCUMENTS 3,890,704 6/1975 Ferraro ..... 30/50 X
4,059,891 11/1977 Panagiotoulis .
4,501,067 2/1985 Duncan ..... 30/77 X

FOREIGN PATENT DOCUMENTS

2091159-A 7/1982 United Kingdom .

*Primary Examiner*—E. R. Kazenske
*Assistant Examiner*—Michael D. Folkerts
*Attorney, Agent, or Firm*—Raymond J. De Vellis

[57] ABSTRACT

In a razor blade unit having a blade (or blades) secured to a carrier, the carrier includes a protecting bar for protecting the blade edge and which bar is removable by breaking frangible connecting fingers linking the bar with a portion of the carrier mounting the blade.

6 Claims, 5 Drawing Figures

SAFETY RAZOR BLADES

This invention relates to blades for safety razors, and to safety razors utilizing such blades.

Razor blades have very sharp edges which present an obvious risk of injury to users of the blades when loading them into razors by hand. Additionally, some users find difficulty in loading blades accurately on to razors, due, for example, to somewhat limited dexterity.

The present invention aims at reducing these problems in a simple and inexpensive manner, without resort to the provision of dispensing containers such as are commonly used for conventional double-edged wafer blades, or to blade cartridges, in which the blade members are assembled in the factory into razor heads for removable mounting on to razor handles.

In accordance with a feature of the present invention there is provided a razor blade unit comprising at least one razor blade and carrier having a base portion permanently secured to the razor blade and an edge protecting bar positioned in front of the (or each) blade edge, the bar being integrally connected to the base portion by frangible connecting means.

With this construction, the blade and carrier can be handled as a unit to position them in a razor head, and then the protecting bar can be removed by breaking the frangible connecting means.

The invention can be applied to a single blade member, but is particularly advantageous in its application to tandem edged blade units, i.e. units comprising a pair of blades having respective cutting edges which are in spaced parallel relationship for operating in tandem upon the skin of the user.

In such units the base portion of the carrier is secured to and sandwiched between the blades to act as a spacer.

The invention also provides a novel form of razor for use with the blade units of the present invention.

Some embodiments of the invention will now be described in detail, by way of example, with reference to the accompanying drawings, in which.

Figure 1:
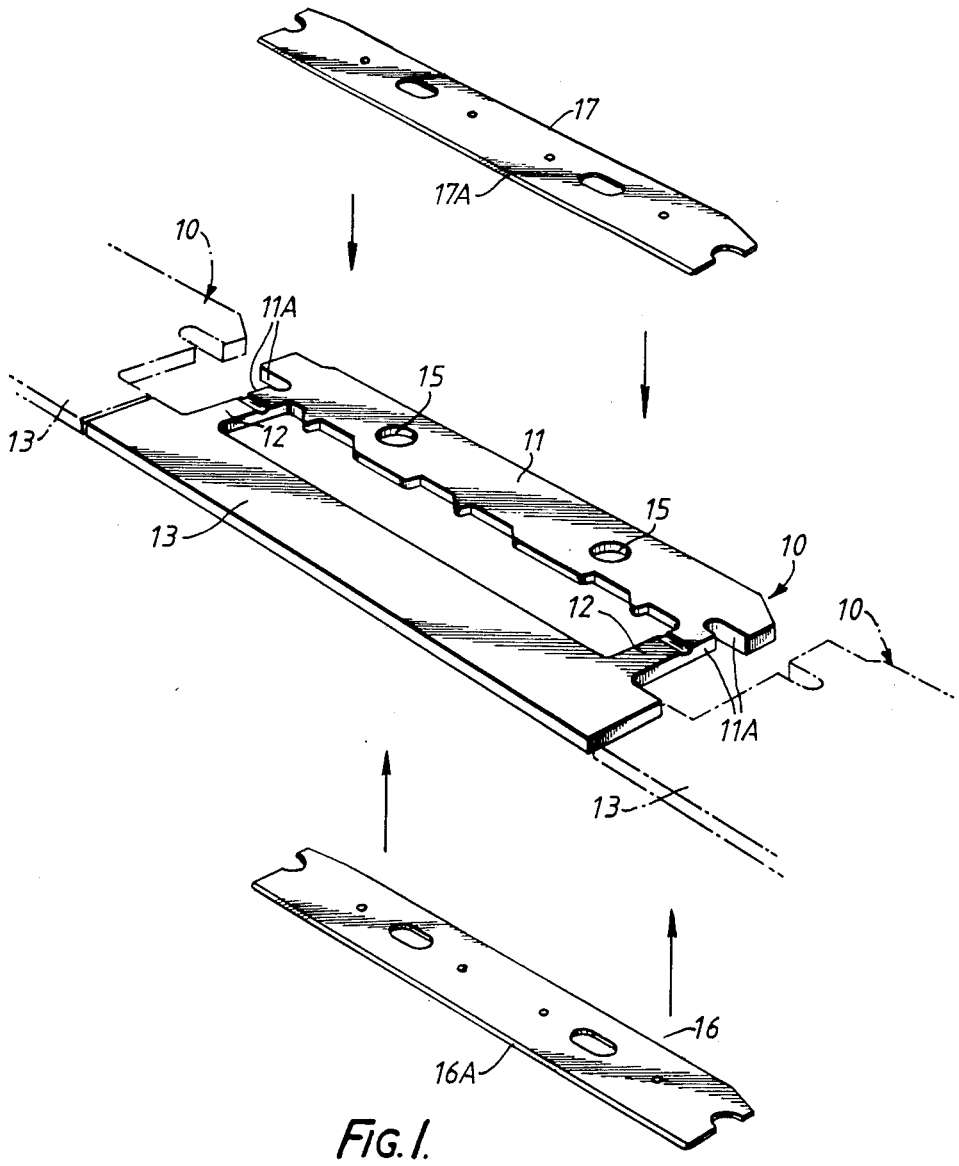
FIG. 1 is an exploded perspective view of a twin blade unit in accordance with the invention.

The blade carrier 10 shown in FIG. 1 comprises a base portion 11 formed with through holes 15, frangible connection fingers 12 at each end, and a blade edge protecting bar 13 integral with the fingers 12. The carriers are conveniently formed in plastics material and connected to each other in a strip by frangible connections between the bars 13.

Secured to opposite faces of the base portion 11 are narrow, single-edged blades 16 and 17, their sharpened edges 16A, 17A being directed forwardly, towards the bar 13. The blades are permanently secured to the base portion 11, for example by riveting, so that the base portion maintains the required spatial relationship between the blade edges, the lower edge 16A, being set forward of and below the upper edge 17A, so that the edges operate in tandem upon the skin of the user.

Figure 4:
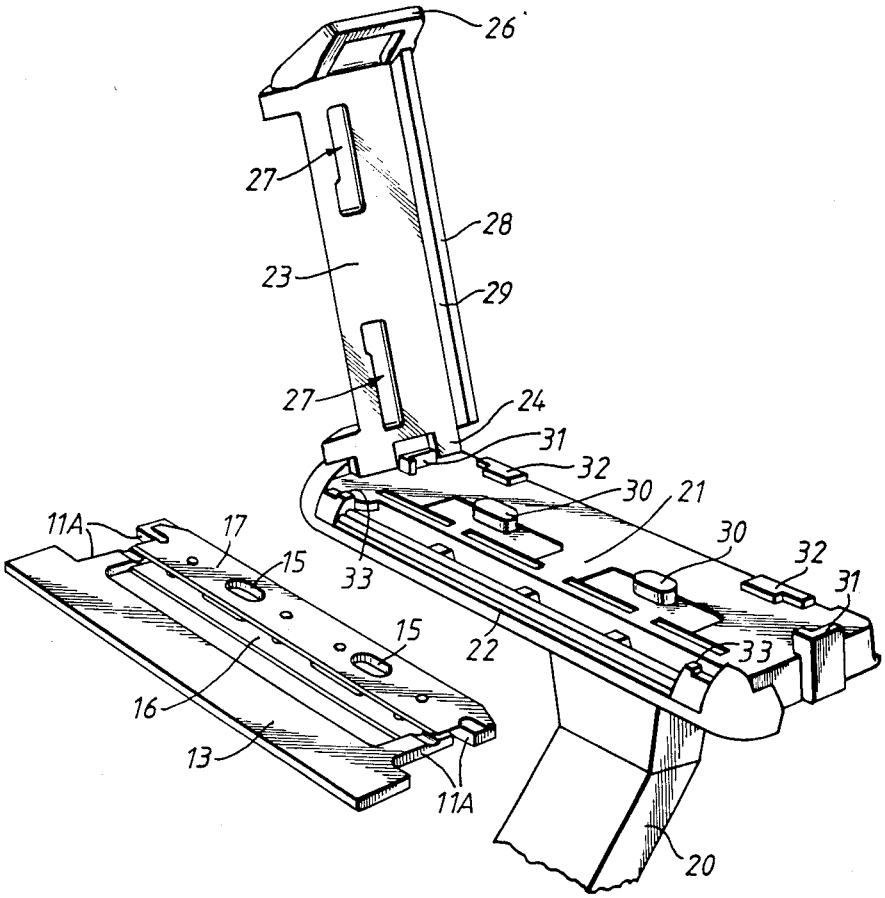
FIG. 4 is a perspective view of a razor in accordance with the invention and of the blade unit of FIG. 1.

The ends of the base portion 11 are notched to provide locating faces 11A which provide for accurate location of the unit in a co-operating razor head, as described below. The complete unit is illustrated in FIG. 4.

Figure 2:
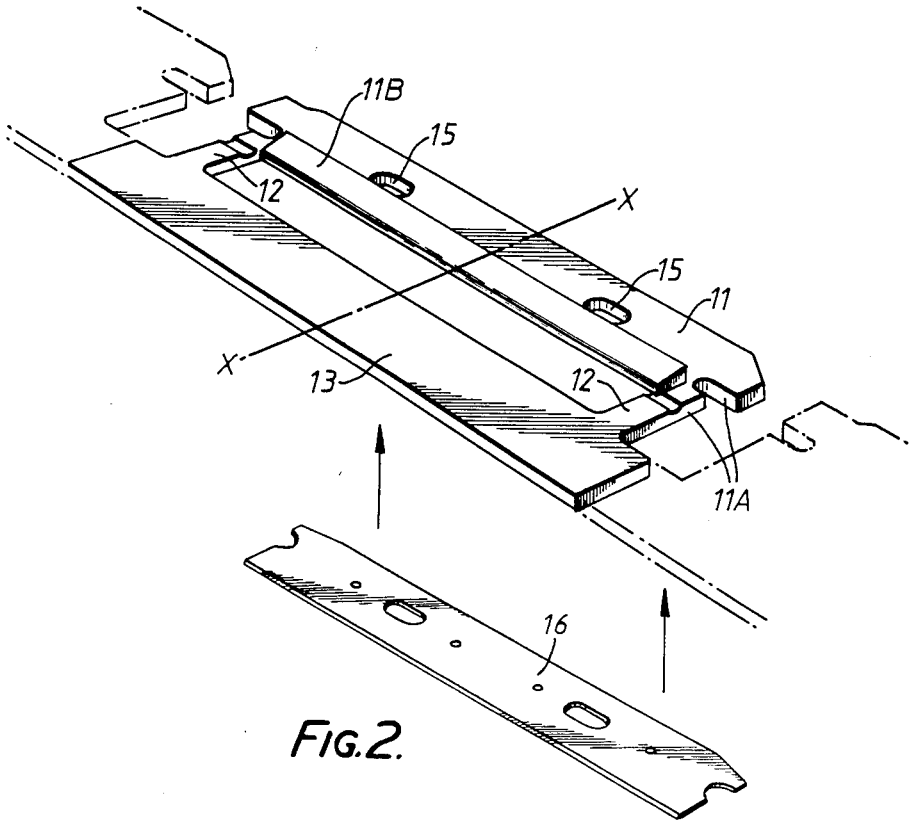
FIG. 2 is a view, similar to FIG. 1, of a single blade unit in accordance with the invention.
Figure 3:
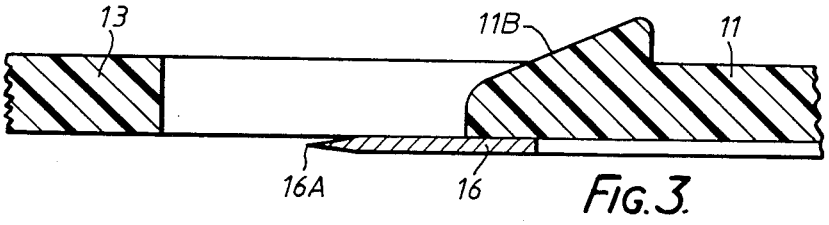
FIGS. 3 and 3A are cross-sections on the line XX in FIG. 2 showing two possible variants.

The blade unit shown in FIGS. 2 and 3 has but a single blade 16 secured to the underside of the base portion 11 of the carrier, which is very similar to that of FIG. 1, but in which the leading edge 11B of the base portion is thickened and shaped to enable it to act as skin-engaging surface.

The above described blade units can conveniently be designed to have the same overall length and width as standard double-edged razor blades and can be packaged using existing machinery for the packaging of standard blades.

Handling of the blade units by the user is greatly facilitated by the protecting bar 13, which is easily gripped without any substantial risk of the fingers encountering the blade or edges. Once the unit is positioned on a razor head and the head closed to grip the blade, or blades, and base portion, the bar 13 is easily removed by bending and thus breaking the fingers 12.

FIG. 4 illustrates a razor designed to employ the blade units of FIGS. 2 and 3. It comprises a unitary plastics moulding formed to provide an elongate handle 20, a blade platform 21 and guard bar 22, and a hinged cap 23 shown in its raised, or open position in FIG. 4. The cap is integrally connected to one end of the platform by a living hinge 24 which enables the cap to be swung down to a closed position overlying the platform, to which it is securely but releasably locked by a snap-fitting catch 26, which is releasable by flexing it outwardly.

The cap 23 is formed with a pair of elongate recesses 27 and, at its rear edge, with a depending flange 28 having a sloping ramp face 29 facing forwardly.

The blade platform 21 is generally planar, but has a pair of upstanding pins 30, a pair of end location blocks 31, rear location blocks 32 and edge locating stops 33.

In use, with the cap open, a blade unit, held by its bar 13 is first approximately located by the pins 30, which pass through the holes 15, and by the inner faces of the blocks 31 engaging in the notches of base portion 11, and by the forward faces of blocks 32 engaging the rear edge of the blade unit. The cap is then closed to lock the blade unit in position, and during the closing movement, the ramp surface 29 urges the unit forwardly to engage the blade edge(s) against the locating stops 33.

The unit is thus precisely located relative to the guard bar 22 and the cap of the razor. If a single blade unit is employed the cap surface is supplemented by the thickened leading edge portion 11B of the base portion 11, which blends smoothly with the cap surface. Finally, the bar 13 is broken away and discarded to render the razor ready for use.

Blade units in accordance with the invention may also be employed in the factory assembly, especially by hand, of disposable razors or blade cartridges. For this purpose, the razor cap may be formed as a separate component which is irreversibly snap-fitted on to the razor to clamp the blade unit.

Figure 3A:
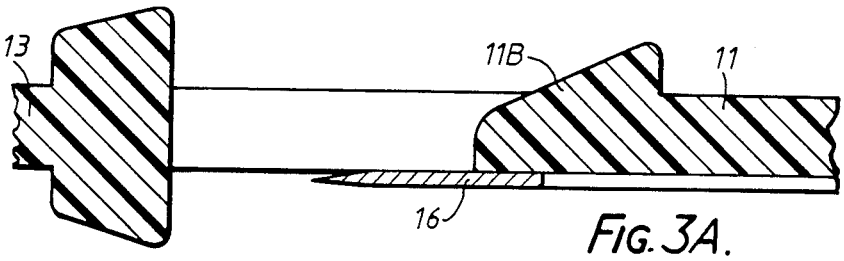

According to the variant shown in FIG. 3A, the bar 13 is thickened to give a further degree of protection to the blade edge. This variant is applicable to both single and twin blade units.

What is claimed is:

1. A razor blade unit, for use on the head of a safety razor comprising a razor blade having a sharpened blade edge, and a carrier for said razor blade, said carrier comprising:

a base portion substantially along the entire length of said sharpened blade edge and permanently secured to a surface of said blade;

an edge-protecting bar positioned in front of said sharpened blade edge; and frangible connecting means including a first narrow finger projecting from said base portion integrally connecting said bar to said base portion, whereby said edge-protecting bar is separated from said base portion prior to use of said sharpened blade edge.

2. A razor blade unit as claimed in claim 1, comprising a pair of razor blades, each having a sharpened blade edge, said blades being permanently secured to said base portion on opposite sides thereof with said cutting edges disposed in spaced parallel relation for operating in tandem upon the skin of the user, and wherein said edge protecting bar is positioned to protect both of said blade edges.

3. A razor blade unit according to claim 1, comprising but one single-edged said razor blade secured to an underside of said base portion, said portion having a leading edge behind said sharpened blade edge, which is thickened and shaped to enable it to act as a skin-engaging surface behind said sharpened blade edge.

4. A razor blade unit according to claim 1 wherein said frangible connecting means includes a second narrow finger, said first and second narrow fingers projecting forwardly from opposite ends of said base portion.

5. A razor blade unit according to claim 1, wherein the ends of said base portion are formed with notches destined to co-operate with locating means formed on a razor.

6. A shaving system comprising a safety razor and a razor blade unit, said razor blade unit including a razor blade having a sharpened blade edge, and a carrier for said razor blade, said carrier including a base portion permanently secured to said blade, an edge protecting bar positioned in front of said sharpened blade edge, and a frangible connecting means integrally connecting said bar to said base portion, said safety razor including a blade platform and a cap movable relative to said blade platform between an open position and a closed position, said platform having means for locating said blade unit relative thereto; closure of said cap serving to clamp said carrier to said platform, with said frangible connecting means projecting from between said cap and said platform.

* * * * *